United States Patent [19]

Korenko et al.

[11] Patent Number: 4,572,738

[45] Date of Patent: Feb. 25, 1986

[54] MARAGING SUPERALLOYS AND HEAT TREATMENT PROCESSES

[75] Inventors: Michael K. Korenko, Wexford, Pa.; David S. Gelles, W. Richland; Larry E. Thomas, Richland, both of Wash.

[73] Assignee: The United States of America as represented by the United States Department of Energy, Washington, D.C.

[21] Appl. No.: 370,439

[22] Filed: Apr. 21, 1982

Related U.S. Application Data

[63] Continuation-in-part of Ser. No. 305,411, Sep. 24, 1981, abandoned.

[51] Int. Cl.[4] ..... C21D 7/14

[52] U.S. Cl. ..... 75/128 Z; 75/128 T; 75/128 W; 148/136; 148/148; 148/12 E

[58] Field of Search ..... 75/128 T, 128 W, 124, 75/128 Z; 148/39, 37, 38, 136, 12 R, 12 EA, 12 E, 148, 12.3

[56] References Cited

U.S. PATENT DOCUMENTS

| | | | |
|---|---|---|---|
| 3,199,978 | 8/1965 | Brown et al. | 75/128 F |
| 4,049,431 | 9/1977 | Hagel et al. | 148/37 |
| 4,125,260 | 11/1978 | Kanne et al. | 75/124 |
| 4,129,462 | 12/1978 | Korenko | 148/31 |
| 4,172,742 | 10/1979 | Rowcliffe et al. | 148/38 |
| 4,259,126 | 3/1981 | Cole et al. | 75/124 |
| 4,359,349 | 11/1982 | Merrick et al. | 148/12.7 N |

FOREIGN PATENT DOCUMENTS 1104932 3/1968 United Kingdom .

OTHER PUBLICATIONS

Cupp et al., Trans. Metall. Soc. of AIME, 239, pp. 1468–1472, Sep. 1967.

Metals Progress, vol. 28, pp. 99–100, Nov. 1980.

Hall et al., NASA-SP-5051, U.S. Gov't. Printing Off., p. 137, 1968.

Floreen, Metals and Materials, 2, pp. 115–128, 1968.

Metals Handbook; vol. 2, 8th Ed., pp. 255–256, 1964.

Floreen, Trans. Metall. Soc. of AIME, 236, pp. 1429–1440, Oct. 1966.

*Primary Examiner*—Veronica O'Keefe

*Attorney, Agent, or Firm*—John J. Prizzi

[57] ABSTRACT

Described herein are nickel-chromium-iron maraging, gamma prime strengthened superalloys containing about 18 to 25 weight percent nickel, about 4 to 8 weight percent chromium, gamma prime forming elements such as aluminum and/or titanium, and a solid solution strengthening element, such as molybdenum. After heat treatment, which includes at least one ausaging treatment and at least one maraging treatment, a microstructure containing gamma prime phase and decomposed Fe-Ni-Cr type martensite is produced.

25 Claims, 8 Drawing Figures

D21-C24
X 80,000

D21-C25
X 40,000

D21 - C26
X 40,000

D21-C26
X 20,000

D21-B1
X 20,000

MARAGING SUPERALLOYS AND HEAT TREATMENT PROCESSES

GOVERNMENT CONTRACT CLAUSE

The present invention was made or conceived during the performance of work under Contract No. EY-76-C-14-2170 with the U.S. Department of Energy.

CROSS-REFERENCE TO RELATED APPLICATION

This application is a continuation-in-part of Ser. No. 305,411, filed Sept. 24, 1981, and assigned to the same assignee as the present invention and now abandoned.

BACKGROUND OF THE INVENTION

This invention relates to the alloy art and has particular relationship to superalloys and the method of heat treating these alloys. Superalloys are alloys having high strength at elevated temperatures.

This invention arises out of experience with nuclear reactors particularly of the fast breeder, liquid metal type. Notwithstanding the origin of this invention, it is to be understood that this invention is in no respect confined in its scope to nuclear reactors. To the extent that the alloys created pursuant to this invention or the method by which these alloys are processed may find general use; such use is within the scope of the invention.

In fast breeder nuclear reactors of the liquid metal type, as well as in others, the fuel is encapsulated in cladding, typically of cylindrical form. A capsule containing the fuel is usually referred to as a fuel element or fuel rod. In accordance with the teachings of the prior art, the cladding is composed of stainless steel, typically AISI 316 stainless steel. The ducts through which the liquid metal (typically sodium) flows are also composed of this 316 steel. In practice, difficulty has been experienced both with the cladding and the ducts. The stainless steel on being bombarded by neutrons, particularly where the neutron flux is epithermal ($E>0.1$ MeV), swells. In addition, the stainless steel does not have the necessary strength at the elevated temperatures, 500° C. and higher, at which the reactors of the type involved operate. The problem is particularly serious in the case of the cladding. On being heated by the fission reaction, the fuel in the capsules expands and in addition gas is generated and exerts high pressure at the high temperatures within the capsules. The cladding is highly stressed. The stress exerted in the ducts is at a lower level both because the temperature of the ducts is lower than that of the cladding and also because the mechanical pressure to which the ducts are subjected is lower. The stainless steel of the cladding and of the ducts is subject to substantial creep which is accentuated by the neutron irradiation.

Various alloys have been considered in efforts to provide improved cladding and duct materials. Among the alloys studied have been gamma prime hardened austenitic superalloys such as those described in U.S. Pat. Nos. 3,199,978; 4,129,462; and 4,172,742. In addition to the metallurgical conditions described in the listed patents, these alloys have also been studied in a solution treated and cold worked condition. These gamma prime austenitics can generally be designed to have good swelling resistance, high strength and high stress rupture strength relative to austenitic alloy 316.

Another class of alloys under consideration for use as cladding and duct material are the fully ferritic precipitation hardening alloys containing little, if any, nickel. Examples of these alloys are described in U.S. Pat. No. 4,049,431. It is believed these alloys, when properly treated, can provide a combination of swelling resistance, acceptable ductility and high strength at the temperature typically encountered by liquid metal fast breeder reactor cladding.

BRIEF SUMMARY OF THE INVENTION

In accordance with the present invention, a new class of maraging superalloys have been found and are believed to be suitable for use in liquid metal fast breeder reactors. These alloys are nickel-chromium-iron base maraging, gamma-prime strengthened superalloys containing about 18 to 25 weight percent nickel, about 4 to 8 weight percent chromium, quantities of one or both of the gamma prime forming elements, aluminum and titanium, as well as a solid solution strengthening agent, molybdenum. The microstructure of the heat treated alloy contains gamma prime and a decomposed Fe-Ni-Cr type martensite. The decomposed martensite structure comprises gamma prime and beta prime precipitates within a ferritic matrix. In addition retained austenite and Fe-Ni-Cr type martensite may also be present.

Alloys according to this invention, in their fully heat treated condition, have been found to possess a combination of excellent ductility and strength, from room temperature through 650° C., as well as being resistant to swelling.

Preferably the alloy according to the present invention contains 0.5 to 1.5 weight percent of the aforementioned solid solution strengthening agent, which is preferably Mo. Most preferably the Mo is held to about 1 weight percent.

Preferably the alloy contains about 1.5 to 3.5 weight percent titanium and 0.4 to 2.5 weight percent aluminum, as the aforementioned gamma prime forming elements.

The alloy according to the present invention may also contain up to about 0.4 weight percent silicon, about 0.01 to 0.1 weight percent carbon and about 0.005 to 0.11 weight percent zirconium. Manganese may be added in levels between about 0.1 to 0.5 weight percent, but should be maintained as low as possible, since high levels of manganese suppress martensite formation.

Also in accordance with the present invention, the alloys are heat treated by first austenitizing the alloy to produce a substantially homogeneous, substantially single phase structure. It is then ausaged so as to form gamma prime phase thereby reducing the nickel content of the austenitic matrix and raising its $M_s$ (martensite start) temperature. The material is then cooled below the $M_s$ temperature so as to at least partially transform the austenite matrix to an Fe-Ni-Cr type martensite, (as opposed to Fe-C type martensites). This Fe-Ni-Cr type martensite has a body centered cubic ferritic crystal structure containing twins, dislocations and various levels of the other elements present in the alloy. The Fe-Ni-Cr martensite may have a plate or needle-like morphology, and it has been referred to, at times, in the maraging literature as massive martensite.

The material is then heated again to form additional gamma prime in the remaining austenite while also maraging the Fe-Ni-Cr type martensite formed in the proceeding step so as to produce a decomposed Fe-Ni- Cr type martensite containing gamma prime as well as other phases or precipitates formed during maraging.

The material is then cooled below the $M_s$ temperature of the remaining austenite, transforming a substantial portion of it to Fe-Ni-Cr type martensite.

These heating and cooling steps are repeated as necessary to transform substantially all of the austenite to Fe-Ni-Cr type martensite and marage the martensite so formed.

Preferably the number of maraging and ausaging steps may be reduced by cooling below zero degrees centigrade so as to provide a more complete transformation of austenite to martensite in each cooling step.

The austenitizing step is performed above the gamma prime solvus, preferably between about 900° to 1200° C., and most preferably at about 1000° C. The initial ausaging step is performed below the gamma prime solvus, preferably between about 750° and 850° C. Subsequent ausaging and maraging steps are preferably performed at about 650° to 800° C. Lower temperature ausaging and maraging treatments at about 450° to 500° C. may be substituted for the 650° to 800° C. treatments and should produce increased strength and lowered ductility in the final product compared to the higher temperature ausaging and maraging treatments. The higher temperature ausaging and maraging treatments, however, are preferred for high temperature applications, such as the liquid metal fast breeder reactor, since these treatments provide a more stable microstructure than the lower temperature treatments.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which.

DETAILED DESCRIPTION OF THE INVENTION

Figure 1:
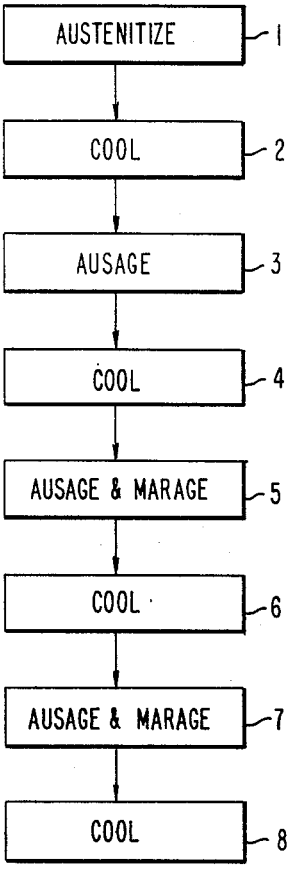
FIG. 1 is a process flow diagram of an embodiment of a heat treating process in accordance with the present invention.

The general composition range of the alloy according to this invention is as follows:

about 18–25 weight percent nickel
about 4–8 weight percent chromium
about 0.5–1.5 weight percent molybdenum
about 1.5–3.5 weight percent titanium
about 0.4–2.5 weight percent aluminum with iron being essentially the balance except for impurities.

The chromium is added for corrosion resistance, but is kept below about 8 weight percent since increasing chromium content tends to reduce the rate of gamma prime ($Ni_3(Al,Ti)$) formation by reducing the gamma prime solvus temperature as well as suppressing the $M_s$ temperature. Above about 8% chromium the reduced rate of gamma prime formation during ausaging makes the reduction of the nickel content of the austenite matrix by gamma prime formation impractical. However, in order to assure minimal levels of corrosion resistance, the chromium content should be maintained above about 4 weight percent.

The molybdenum content should be held below 1.5 weight percent in order to avoid Laves phase formation in pile which may be detrimental to the swelling resistance of the alloy. However, molybdenum should be present at a level of at least 0.5 weight percent to provide solid solution strengthening. Most preferably the molybdenum should be held at about 1 weight percent so as to provide solid solution strengthening while avoiding Laves phase formation.

Titanium and aluminum form the gamma prime phase ($Ni_3(Ti,Al)$) during ausaging, reducing the nickel content of the austenite matrix and thus raising its $M_s$ temperature so that Fe-Ni-Cr type martensite will form on cooling to room temperature. The aluminum content of this alloy avoids eta phase formation and also serves to enhance precipitate phase stability in pile, thereby helping to minimize swelling. In the fully heat treated or maraged condition, gamma prime forms a significant portion of the microstructure and is the major contributor to the high strength of the alloy. The volume fraction of gamma prime phase may be as high as about 25 percent.

In addition to the above elements the alloy may contain about 0.1 to 0.5 weight percent manganese and between about 0.01 to 0.1 weight percent carbon. The alloy may also optionally contain up to about 0.4 weight percent silicon and about 0.005 to 0.11 weight percent zirconium as aids to swelling inhibition.

Table I lists the nominal composition of four alloys in accordance with the present invention. The chemical analysis obtained upon testing these heats are shown in Table II. Test results from two analyses of at least the alloying elements of alloys D21-C24, D21-C26 and D21-C25, are provided.

TABLE I

| | ALLOY NOMINAL COMPOSITIONS | | | |
|---|---|---|---|---|
| | MARAGING SUPERALLOYS | | | |
| ELEMENT | D21-C24 | D21-B1 | D21-C26 | D21-C25 |
| Ni | 25 | 25 | 20 | 20 |
| Cr | 5.5 | 7.5 | 5.5 | 7.5 |
| Mo | 1.0 | 1.0 | 1.0 | 1.0 |
| Si | 0.3 | 0.3 | 0.3 | 0.3 |
| Mn | 0.2 | 0.2 | 0.2 | 0.2 |
| Zr | 0.05 | 0.05 | 0.05 | 0.05 |
| Ti | 3.3 | 3.3 | 3.3 | 3.3 |
| Al | 1.7 | 1.7 | 1.7 | 1.7 |
| C | 0.05 | 0.05 | 0.05 | 0.05 |
| Fe* | ess. bal. | ess. bal. | ess. bal. | ess. bal. |

*iron is essentially the balance of these alloys except for impurities

TABLE II

| | HEAT ANALYSES | | | |
|---|---|---|---|---|
| | MARAGING SUPERALLOYS | | | |
| ELEMENT | D21-C24 | D21-B1 | D21-C26 | D21-C25 |
| Ni | 23.75–24.32 | 24.72 | 18.80–19.87 | 19.70–20.03 |
| Cr | 5.46–5.74 | 7.75 | 5.58–5.85 | 7.60–7.71 |
| Mo | 0.87–1.01 | 1.03 | 0.91–1.03 | 0.89–1.02 |
| Nb | <.01–.01 | 0.006 | <.01–0.01 | <.01–0.01 |
| Si | 0.22–0.34 | 0.36 | 0.31–0.34 | 0.32–0.34 |
| Mn | 0.14–0.22 | 0.20 | 0.14–0.21 | 0.17–0.22 |
| Zr | 0.07–.074 | 0.104 | 0.04–.069 | 0.04–0.069 |
| Ti | 3.1–3.26 | 3.27 | 3.13–3.38 | 3.11–3.34 |
| Al | 1.37–1.6 | 1.79 | 1.08–1.74 | 1.15–1.70 |

TABLE II-continued

| ELEMENT | HEAT ANALYSES MARAGING SUPERALLOYS | | | |
|---|---|---|---|---|
| | D21-C24 | D21-B1 | D21-C26 | D21-C25 |
| C | 0.048-0.06 | 0.045 | 0.052-0.07 | 0.051-0.07 |
| P | 0.004-<.005 | NA* | <.005-0.024 | <.005-0.024 |
| S | 0.002-0.005 | NA* | 0.002-.003 | 0.002 |
| Cu | 0.07 | NA* | 0.04 | 0.05 |
| V | 0.12 | <0.005 | 0.12 | 0.12 |
| Ta | 0.01 | <0.01 | 0.01 | 0.01 |
| O | 0.0230 | 0.003 | 0.0140 | 0.0520 |
| N | 0.0021 | 0.002 | 0.0015 | 0.0025 |
| B | 0.0030 | NA* | 0.0035 | 0.0043 |

*NA = not analyzed

Ingots of alloys having the general composition of the present invention may be typically hot worked to an intermediate size to improve chemical homogeneity while substantially removing the as cast structure.

This primary fabrication step can take the form of soaking the ingot for about 2 hours at about 1050° to 1200° C. and then extruding the ingot while it is at temperature to a $\frac{5}{8}''$ diameter stock. This intermediate product may then be cold rolled in steps to the desired final size and shape. For example, in the fabrication of alloy D21-C26 cold reductions of 30 to 60% were utilized with intermediate anneals at 1000° C. for 5 minutes between each reduction. In this manner sheet material as thin as 0.012 inch was fabricated. Flat tensile specimens were machined from 0.030 inch thick sheet. Tubing was fabricated by machining of cold rolled stock.

The ferritic nature of these alloys was discovered by accident. Alloy D21-B1 was originally thought to be an austenitic gamma prime hardened alloy similar to the alloys described in U.S. Pat. No. 4,172,742. However after aging in reactor in the temperature range 425°-650° C. for 1500-2000 hours and also after thermal aging, at 650° C. for 3000 hours it was found that the alloy was martensitic. Alloy D21-B1 also has revealed that alloys as described above with decomposed martensitic structure are resistant to neutron irradiation. It has been found that the decomposed martensitic structure develops no void swelling following irradiation to $5-7\times10^{22}$ neutrons per square centimeter over the temperature range of 425° to 650° C. The microstructure of this alloy has been found to remain stable under neutron irradiation.

In the typical practice of the present invention the final size and shape articles which are typically in a cold worked condition are treated as follows: (see FIG. 1)

1. The alloy is first austenitized so as to produce a structure which is substantially all austenite and has improved chemical homogeneity. For the thin section samples studied, a treatment at 1000° C. for 15 minutes was found to be sufficient.

2. The alloy may then be cooled to room temperature or below, or directly to the ausaging temperature. The materials described in the application were cooled to room temperature.

3. The alloy is then ausaged. This treatment may be performed between about 650° to 850° C. During ausaging, gamma prime phase is formed in the austenite and begins to reduce the nickel content of the austenite. For any desired level of gamma prime precipitation, the temperature and time at temperature utilized for this step is dependent upon the rate of the austenite/gamma prime transformation reaction, which is in turn dependent on the alloy composition. For the alloys studied, eight hours at 750° C. was utilized. This treatment was found to have sufficiently reduced the nickel content of at least a portion of the remaining austenite matrix such that its $M_s$ temperature was raised above room temperature.

4. The alloy is then cooled below the $M_s$ temperature of the aforementioned portion of the remaining austenite phase to at least partially transform this unstable austenite to an iron-nickel-chromium type martensite phase. The amount of austenite transformed will depend upon the $M_s$ temperature of the austenite matrix in a selected volume of material and the magnitude of the temperature reduction below the $M_s$ temperature. In the examples shown here all alloys were cooled to room temperature.

5. The alloy is then reheated so as to further ausage the remaining austenite while also maraging or tempering the martensite formed during the proceeding step. During this maraging and ausaging step, the $M_s$ temperature of the remaining austenite is raised as in the manner described in step 3 by additional gamma prime precipitation. The martensite marages, or decomposes, to a decomposed martensite structure. This decomposition takes the form of the precipitation of nickel, titanium and aluminum atoms held in solution in the martensite as beta prime ($Ni_2TiAl$) precipitates and growth of gamma prime ($Ni_3(Al,Ti)$) precipitates. The decomposed martensite is then composed of gamma prime and beta prime precipitates in a ferrite matrix. This ausaging and maraging step may be performed at about 650° to 800° C. In the samples shown here the alloys were held at about 700° C. for about 8 hours.

6. The alloy is cooled below the $M_s$ temperature of the remaining austenite. It is desired that during this step all the remaining austenite be transformed to martensite. In the examples of the invention illustrated here, all alloys were cooled to room temperature.

7. Step 5 is repeated, but in this case most, if not all, of the austenite has been transformed to martensite by the preceding steps, so that the maraging reaction should be the only significant reaction occurring during this treatment. In the examples shown here, this treatment was performed at about 650° C. for about 8 hours.

8. The material is then cooled to room temperature.

In the fully heat treated condition the alloy should have a microstructure whose major constituent phases are gamma prime, ferrite and beta prime. There may be minor amounts of other precipitates present as well. In addition, there may also be minor amounts of retained austenite and/or martensite, in regions that may have had initially very high concentrations of nickel and chromium.

While the chemical formulas for the gamma prime and beta prime precipitates have been noted, it should be understood that these phases will also contain varying amounts of the other elements in these alloys in addition to nickel, titanium and aluminum, the major constituents of these phases.

By this treatment a maraged superalloy is produced having the following desirable properties:

1. The very low swelling of a ferritic alloy under neutron bombardment.
2. Very high strength over the whole temperature range over which it may be used.
3. High strength at high temperatures.
4. Good ductility.

5. Low creep even when subject to neutron bombardment.
6. Low thermal coefficient of expansion.
7. A fine-grained microstructure.

This invention is not confined to the above typical treatment. The temperatures to which the alloy is raised, the times during which it is aged at each temperature, and the number of repeated agings and coolings may be varied. It is believed that the number of aging steps may be reduced by cooling to sub-zero temperatures. This alloy following homogenization is treated by repeated aging at temperatures between 650° C. and 850° C., each aging being followed by a cooling. The rate at which the alloy is raised to the aging temperature or is cooled are not critical. If the object is of large volume, the treatment may be carried out in open air. Objects of smaller volume should be treated in a vacuum or other non-reactive atmosphere.

Specimens of maraging superalloy D21-C26 of Table I were tested for strength and ductility. The maraging superalloy, tested after a sequence of three long-term aging treatments, according to the typical treatment described above, was found to be by far the strongest of a number of ferritic alloys tested. Its ultimate strength at room temperature is 1780 megapascals, more than half again as high as the highest strength martensitic alloy tested. At 650° C., the strength of the superalloy according to this invention exceeds that of the conventional 300-series austenitics.

The superalloy according to the invention exhibits good ductility over the entire range of test temperatures. Its total elongation behavior gives evidence of behavior approaching superplasticity, particularly at intermediate temperatures where a sharp increase in ductility occurred, peaking at 49 percent at 550° C. These unique tensile properties are summarized in the following Table III:

TABLE III

TENSILE PROPERTIES OF D21-C26 (UNIRRADIATED)

| Test Temp., °C. | Yield Strength ksi | Yield Strength MPa | Ultimate Strength ksi | Ultimate Strength MPa | Elongation, % Uniform | Elongation, % Total | Reduction in Area, % |
|---|---|---|---|---|---|---|---|
| RT | 168.3 | 1160.4 | 258.3 | 1780.9 | 8.0 | 7.7 | 24.9 |
| 232 | 175.4 | 1209.3 | 236.6 | 1631.3 | 6.5 | 8.9 | 33.9 |
| 400 | 166.3 | 1146.6 | 205.6 | 1417.6 | 6.8 | 10.0 | 39.2 |
| 450 | 157.8 | 1088.0 | 197.2 | 1359.6 | 10.8 | 15.6 | 52.0 |
| 500 | 127.4 | 878.4 | 148.9 | 1026.6 | 9.6 | 23.2 | 65.4 |
| 550 | 97.6 | 672.9 | 117.2 | 808.1 | 11.5 | 49.2 | 78.9 |
| 600 | 69.4 | 478.5 | 89.9 | 619.8 | 9.9 | 31.4 | 90.9 |
| 650 | 70.4 | 485.4 | 82.4 | 568.1 | 11.1 | 41.8 | 84.0 |

*Flat tensile samples were machined from 0.030 inch stock and then fully heat treated as described herein. These test specimens had a gauge length of 0.8 inch, a minimum gauge width of 0.06 inch and were tested at a cross bead speed of 0.020 inch/minute.

Figure 2:
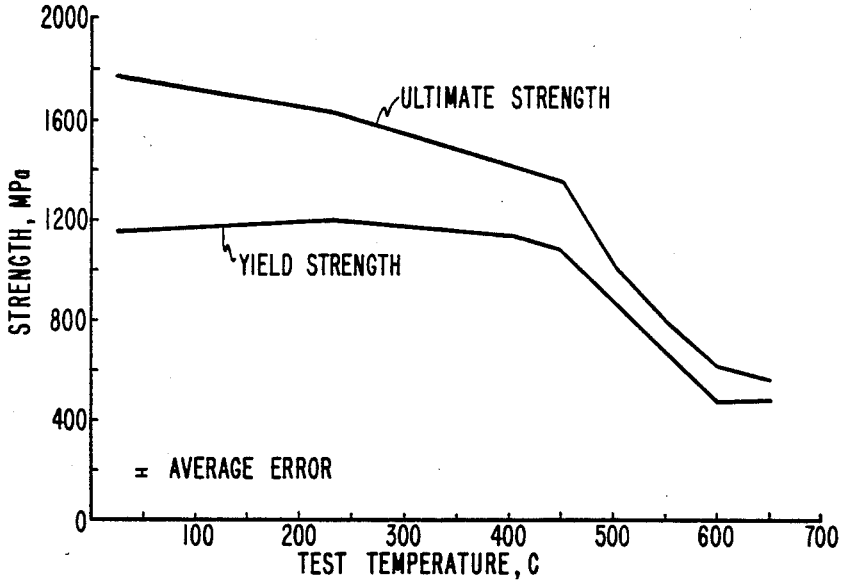
FIG. 2 is a graph in which the strength properties of a superalloy according to the invention are plotted as a function of temperature.
Figure 3:
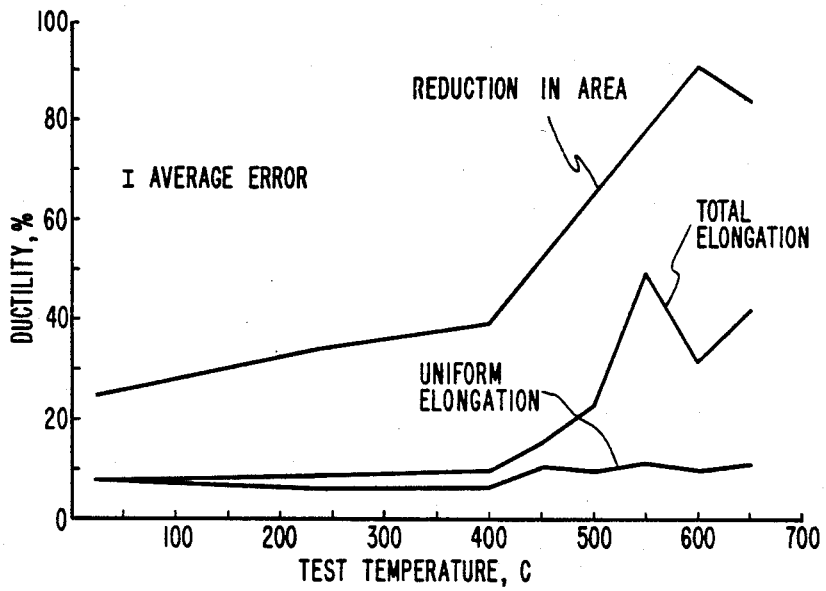
FIG. 3 is a graph in which the ductility properties of a superalloy according to this invention are plotted as a function of temperature.

FIGS. 2 and 3 show graphically the temperature dependencies of strength and ductility of the D21-C26 alloy. In FIG. 2, temperature in C.° is plotted horizontally and strength in megapascals vertically. The ultimate strength and the yield strength were measured at each temperature and are plotted. In FIG. 3, temperature in C.° is plotted horizontally and ductility measurements in percent vertically. Ductility is measured by reduction in area at rupture, total elongation and uniform elongation. These parameters are plotted.

The superalloy according to this invention exhibits an impressive combination of strength, ductility and toughness at elevated temperatures in the fully aged condition, and is clearly the most attractive of a number of ferritic alloys considered from a strength and ductility standpoint. Fabrication of this alloy poses no serious problems.

Figure 4:
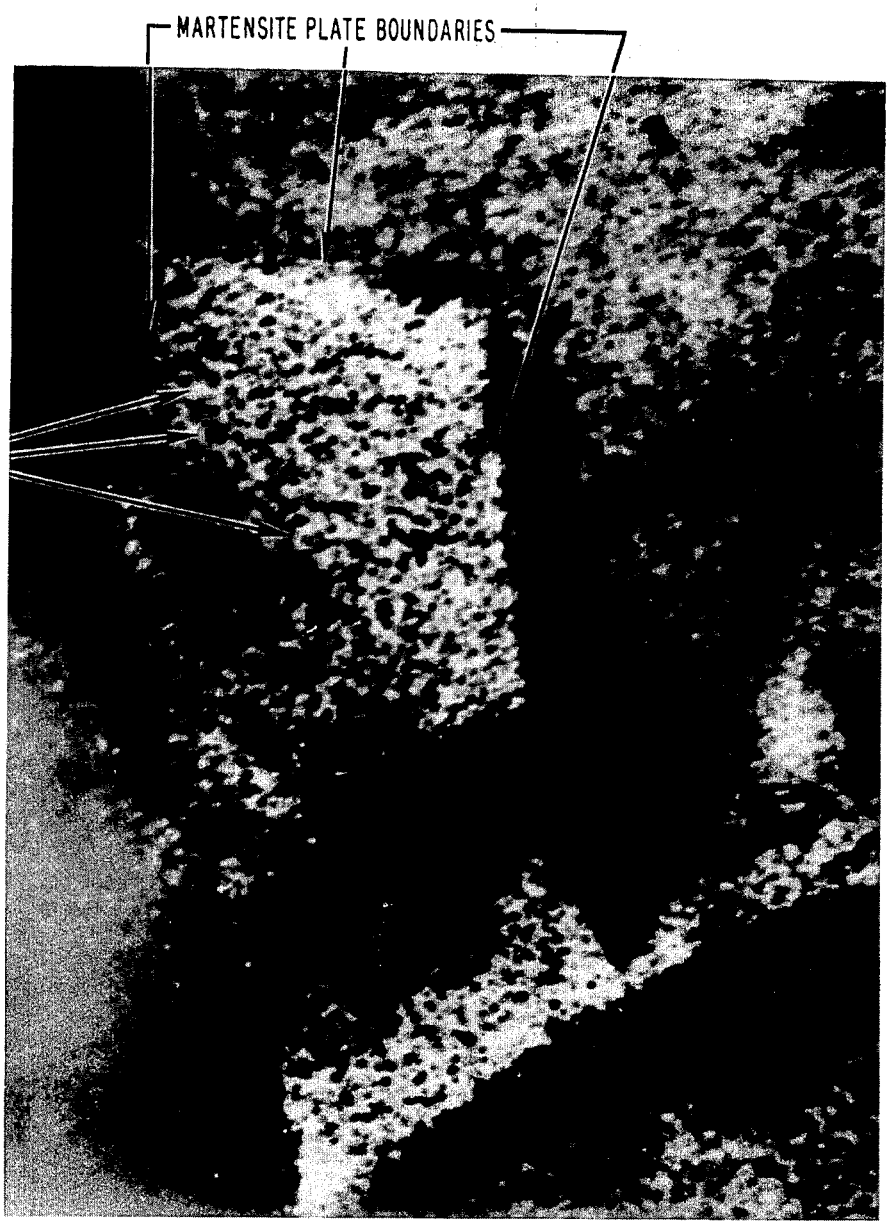
FIGS. 4, 5, 6, 7 and 8 are photomicrographs of maraging alloys according to this invention.
Figure 5:
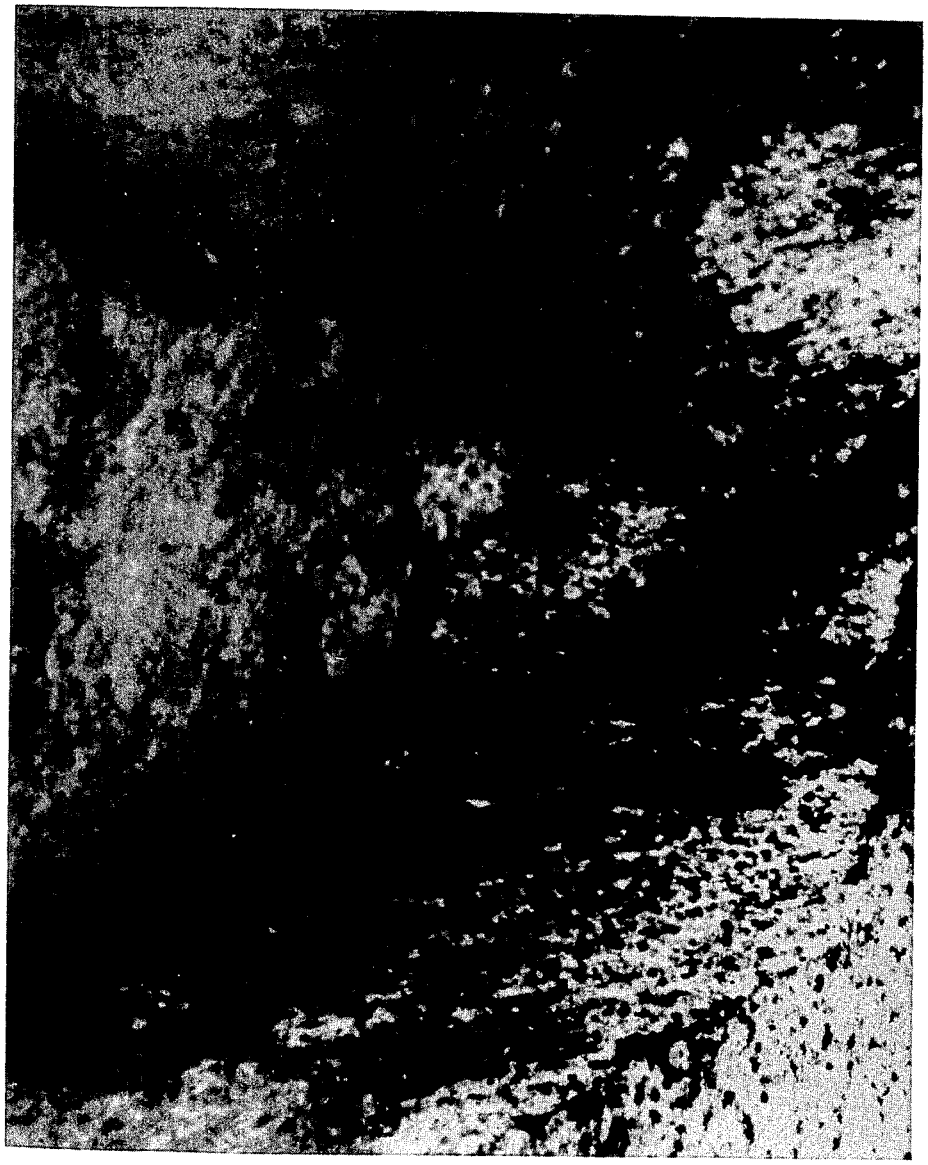
Figure 6:
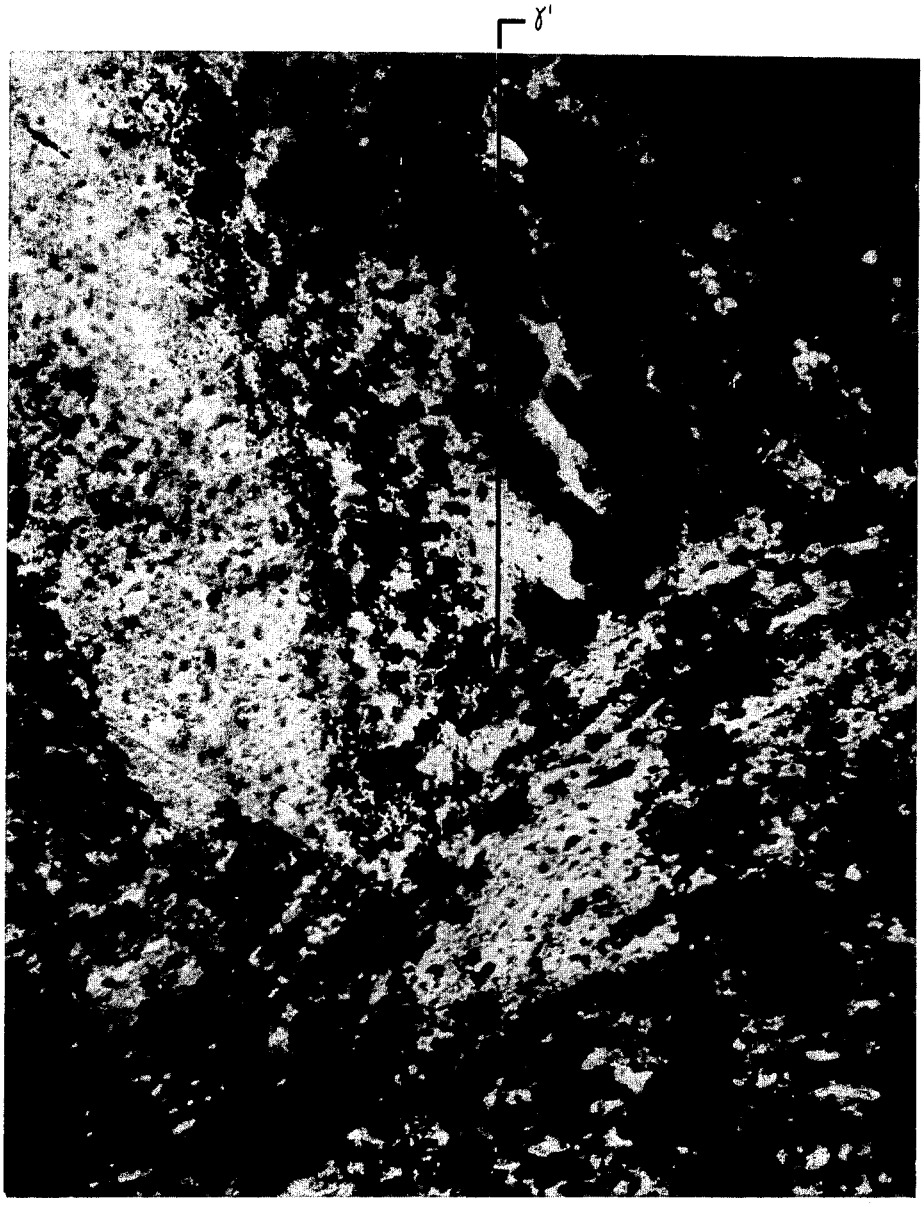
Figure 7:
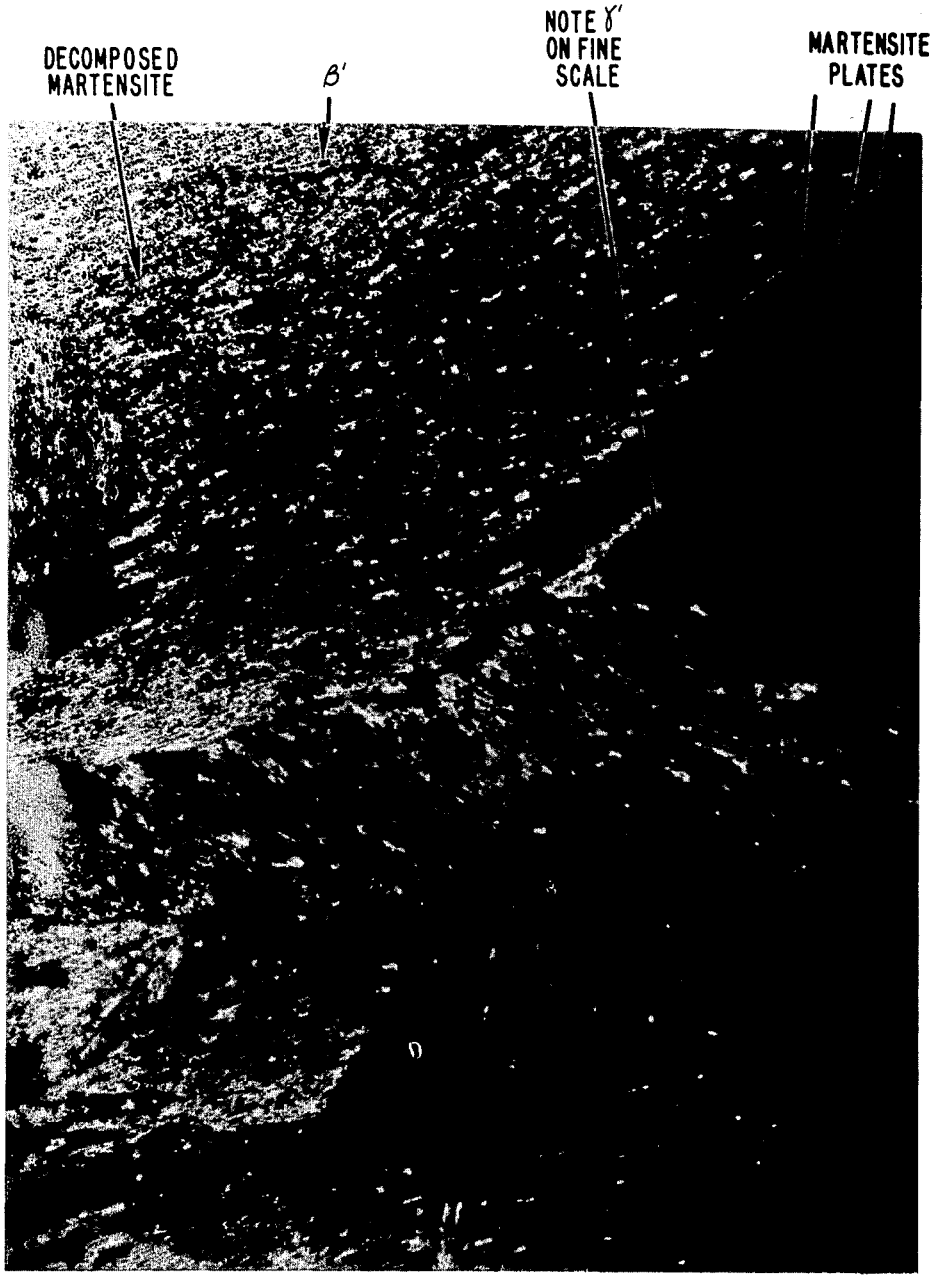

FIGS. 4–7 are examples of the microstructures obtained in the alloys according to the present invention in the fully heat treated condition. FIG. 4 is a photomicrograph of a thin section of alloy D21-C24 at 80,000 magnification. A martensite plate containing gamma prime precipitates (dark) is shown. FIG. 5 is a photomicrograph of a section of the alloy D21-C25 at 40,000 magnification, showing a region of decomposed martensite. FIG. 6 is a photomicrograph of a section of the alloy D21-C26 at 40,000 magnification, showing a region of decomposed martensite and gamma prime phase (small black particles). FIG. 7 is a 20,000× photomicrograph of another region in alloy D21-C26. In the upper left hand corner of FIG. 7 is a region of decomposed martensite. The dark, large chunky particles are beta prime in a ferrite matrix (white background). Martensite plates are shown in the upper right area of the photomicrograph. The fine dark particles are gamma prime phase.

Figure 8:
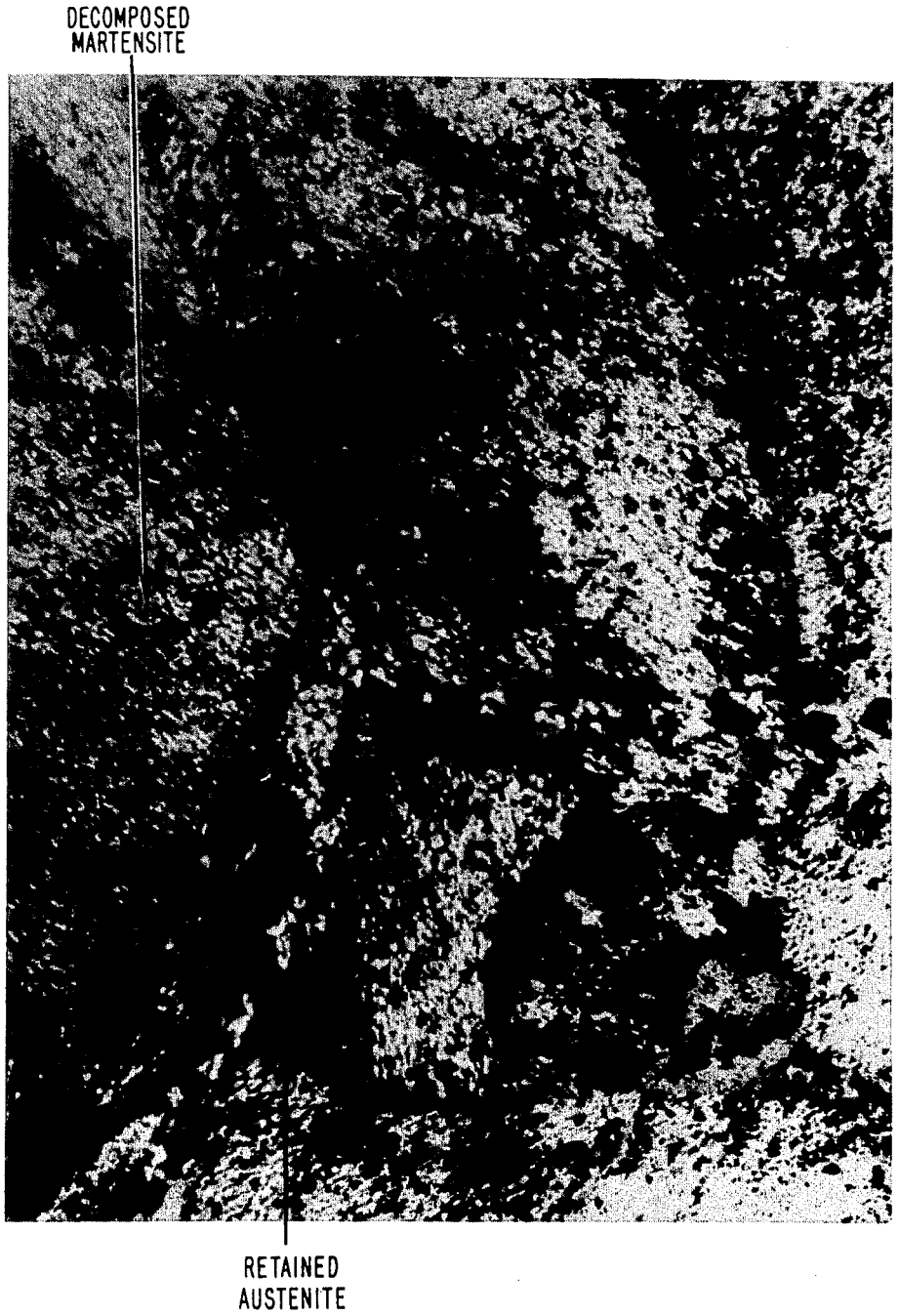

FIG. 8 is a photomicrograph of a section of the alloy D21-B1 at 20,000 magnification after irradiation to $6.9\times10^{22}$ (E>0.1 MeV) neutrons per square centimeter at 510° C. Prior to irradiation, this alloy has been heat treated by solution treating it at 1050° C. for 30 minutes, followed by aging at 800° C. for 11 hours and then 700° C. for 8 hours. After these treatments this alloy was nonmagnetic, that is, it was not martensitic. However, as noted before, after long term aging both in and out of pile this alloy became martensitic. Regions of decomposed martensite and retained austenite are visible in this irradiated section.

Although preferred embodiments of this invention have been disclosed herein, many modifications thereof are feasible. This invention should not be restricted except insofar as is necessitated by the spirit of the prior art.

We claim:

1. An iron base composition maraging superalloy characterized by a gamma prime strengthened microstructure, wherein beta prime precipitates, and gamma prime precipitates are dispersed in a ferritic matrix; and said maraging superalloy consisting essentially of the following elements:
   approximately 18 to 25 weight percent Ni;
   approximately 4 to 8 weight percent Cr;
   approximately 0.5 to 1.5 weight percent of Mo, a solid solution strengthening agent;
   approximately 1.5 to 3.5 weight percent Ti;
   approximately 0.4 to 2.5 weight percent Al;
   and with Fe forming essentially the balance of said iron base composition maraging superalloy.

2. The alloy according to claim 1 wherein the Mo is present at a level of about 1 weight percent.

3. The alloy according to claim 1 or 2 further consisting essentially of:
   up to about 0.4 weight percent Si;
   about 0.01 to 0.1 weight percent C; and
   about 0.005 to 0.11 weight percent Zr.

4. The alloy according to claim 1 further consisting essentially of about 0.1 to 0.5 weight percent Mn.

5. The alloy according to claim 3 further consisting essentially of about 0.1 to 0.5 weight percent Mn.

6. An iron base maraging superalloy consisting essentially of:
   about 18 to 25 weight percent nickel;

about 4 to 8 weight percent chromium;
a gamma prime forming agent selected from the group consisting of Al and Ti, alone or in combination with each other;
about 0.5 to 1.5 weight percent molybdenum, a solid solution strengthening agent;
with iron forming essentially the balance of said alloy;
and a microstructure containing gamma prime phase dispersed in ferrite.

7. The alloy according to claim 6 wherein said microstructure further comprises an Fe-Ni-Cr type martensite phase.

8. The alloy according to claim 6 or 7 wherein said microstructure further comprises an austenite phase.

9. The alloy according to claim 6 wherein said microstructure further comprises a beta prime phase dispersed in said ferrite.

10. The maraging superalloy according to claim 1 consisting essentially of the following nominal composition:
about 25 weight percent Ni;
about 5.5 weight percent Cr;
about 1.0 weight percent Mo;
about 0.3 weight percent Si;
about 0.2 weight percent Mn;
about 0.05 weight percent Zr;
about 3.3 weight percent Ti;
about 1.7 weight percent Al;
about 0.05 weight percent C;
and with the balance being essentially iron except for impurities.

11. The maraging superalloy according to claim 1 consisting essentially of the following nominal composition:
about 20 weight percent Ni;
about 7.5 weight percent Cr;
about 1.0 weight percent Mo;
about 0.3 weight percent Si;
about 0.2 weight percent Mn;
about 0.05 weight percent Zr;
about 3.3 weight percent Ti;
about 1.7 weight percent Al;
about 0.05 weight percent C;
and with the balance being essentially iron except for impurities.

12. The maraging superalloy according to claim 1 consisting essentially of the following nominal composition:
about 20 weight percent Ni;
about 5.5 weight percent Cr;
about 1.0 weight percent Mo;
about 0.3 weight percent Si;
about 0.2 weight percent Mn;
about 0.05 weight percent Zr;
about 3.3 weight percent Ti;
about 1.7 weight percent Al;
about 0.05 weight percent C;
and with the balance being essentially iron except for impurities.

13. The maraging superalloy according to claim 1 consisting essentially of the following nominal composition:
about 20 weight percent Ni;
about 7.5 weight percent Cr;
about 1.0 weight percent Mo;
about 0.3 weight percent Si;
about 0.2 weight percent Mn;
about 0.05 weight percent Zr;
about 3.3 weight percent Ti;
about 1.7 weight percent Al;
about 0.05 weight percent C;
and with the balance being essentially iron except for impurities.

14. A maraging superalloy according to claim 1, 2, 6 or 7, heat treated in accordance with the following process, which comprises the steps of:
austenitizing said alloy;
ausaging said alloy;
cooling said alloy below the $M_s$ temperature;
ausaging and maraging said alloy simultaneously;
cooling said alloy below the $M_s$ temperature.

15. The alloy treated in accordance with claim 14 wherein said ausaging steps comprise forming gamma prime phase in the austenite of said alloy.

16. A method of heat treating an iron-nickel-chromium type maraging superalloy comprising the steps of:
austenitizing said superalloy;
ausaging said alloy;
cooling said alloy below the $M_s$ temperature;
ausaging and maraging said alloy simultaneously;
cooling said alloy below the $M_s$ temperature.

17. The method according to claim 16 further comprising, after the second cooling step, the following steps:
ausaging and maraging said alloy simultaneously;
and then cooling said alloy below the $M_s$ temperature.

18. The method according to claim 16 wherein said cooling steps comprise cooling said alloy to a temperature below 0° C.

19. The method according to claim 17 wherein said cooling steps comprise cooling said alloy to approximately room temperature.

20. The method according to claims 16 or 17 wherein said ausaging steps comprise forming a gamma prime phase in the austenite of said alloy.

21. The method according to claim 20 wherein said ausaging and said maraging steps are performed between about 650° and 800° C.

22. The method according to claim 16 or 17 wherein said initial ausaging step is performed between about 750° and 850° C.

23. The method according to claim 16 or 17 wherein said maraging steps are performed between about 650° and 800° C.

24. The method according to claim 23 wherein said initial ausaging step is performed between about 750° and 850° C.

25. The method according to claim 16 wherein said austenitizing step is performed at about 900° to 1200° C.

* * * * *